United States Patent [19]

Ferguson et al.

[11] 4,035,882

[45] July 19, 1977

[54] LOOM BOBBIN STRIPPER

[75] Inventors: Richard Ferguson; Kenneth W. Troutman, both of Charlotte, N.C.

[73] Assignee: The Terrell Machine Company, Charlotte, N.C.

[21] Appl. No.: 733,411

[22] Filed: Oct. 18, 1976

[51] Int. Cl.[2] ..... D03D 45/60

[52] U.S. Cl. ..... 28/294

[58] Field of Search ..... 28/19, 20, 72 R, 294; 139/255, 261, 262

[56] References Cited

U.S. PATENT DOCUMENTS

| | | | |
|---|---|---|---|
| 2,132,344 | 10/1938 | Kleeb | 28/19 |
| 2,267,678 | 12/1941 | Deal et al. | 28/19 |
| 3,226,793 | 1/1966 | Cullen et al. | 28/19 |
| 3,528,150 | 9/1970 | Schmid | 28/19 X |

*Primary Examiner*—Louis K. Rimrodt

[57] ABSTRACT

A rotating-reel type loom bobbin stripper provides air jets to entrain the waste end of yarn from a bobbin and deliver it to the stripping reels without impinging the jet directly on the yarn bunch. Bow springs automatically apply proper yet readily-releasable tension to the belts feeding the bobbins serially over the reels. A hold-down bar above the row of bobbins being stripped may be lifted readily to clear a jam. Downwardly inclined guide rails deliver bobbins to the feeding belts at an angle causing the bobbins to support themselves by their own heads during delivery and allowing loose waste to be blown down between rails and bobbins by an air jet. The inside walls of the incline rails are relieved to allow any "piece bobbin" which slips into normal position between the rails to travel on freely. A monitoring arm over the incline rails holds back normal "high bobbins" until they are able to fall to normal position hanging between the rails; and it also acts to lever high-riding "piece bobbins" out of the guide rails and over the side. A pair of upwardly inclined feeder belts for receiving, sorting and feeding bobbins upwardly is automatically properly tensioned by a spring, and tapered pulleys act to support most of the weight of the belts while guides at the lower belt edges support a small part of the belt weight and maintain constant spacing between the belts. A bobbin-deflecting and detaining arm near the top of the inclined rails is equipped with a hanging hinged end to detain at least one bobbin there as a buffer for succeeding bobbins. A blower creates air flow past the stripping reels, through a filter, and delivers filtered air to the gears driving the reels. A conveyor carries away unstripped bobbins plus loose waste on a self-tensioned belt trained over pulleys protected from clogging with waste.

17 Claims, 13 Drawing Figures

LOOM BOBBIN STRIPPER

BACKGROUND OF THE INVENTION

Spent filling bobbins when ejected from a loom of the automatic filling replenishment type have residual yarn windings, commonly referred to as a "feeler bunch" or a "bunch," remaining on the bobbin barrel adjacent the bobbin head (butt) which must be removed or stripped before the bobbin can be reused. While highly effective equipment for stripping and disposing of the spent bobbins, and for feeding the spent bobbins from bulk supplies into such stripping equipment, has been developed, the initial stripping means has worked directly and unnecessarily on the bunch; and the entire apparatus has required undue attendance for maintenance of adjustments and for clearing of jams. Previous stripping and feeding equipment is well shown in U.S. Pat. Nos. 3,103,054; 2,854,730; 2,813,616; 2,313,785; 2,132,344; 2,838,824; and 3,966,591. The stripping and feeding arrangement presented here strips the bobbins more effectively, requires far less skill and attention from the attendant or operator (whose working conditions are also vastly improved), requires far less attention and skill for maintenance, and thereby is all together able to be operated in the automatic mode by an attendant who only clears an occasional jam, rather than as heretofore by an operator who continually cleared jams and assisted the equipment in order to get reasonable production.

SUMMARY OF THE INVENTION

The stripping and feeding arrangement of the present invention operates in combination with means for supporting, guiding, and feeding spent filling bobbins serially in a path while hanging from the heads thereof, with rotating reel means spaced below the hanging bobbins for engaging and removing waste yarn therefrom, and with means for delivering stripped and unstripped bobbins to different locations.

The invention comprises improved air jet means for initial delivery of waste yarn to the rotating reels together with improvements in guiding, feeding, and safety means, as explained below.

The air jets are aligned immediately below and beside the heads of the bobbins being stripped, and blow on the depending lower ends of the bobbin barrels; but the barrels and waste thereon are subjected to increasingly swift lengthwise air currents from top to almost bottom for tangle-free delivery of waste yarn to the reels.

A pair of feed belts engage the bobbin heads at the opposite sides thereof and carry the bobbins along the support and guide means provided, the invention comprising bow spring bias means which cause the pulleys at one end of the respective feed belts to maintain proper tension in the respective belts during normal length variations. Each bow spring has one end abutting a fixed support and its other end arranged to bias its respective belt-tensioning pulley, and a bowing-lever forces extra bow into the spring to retract the movable spring end for release of belt tension.

A hold-down bar supported just above the bobbin heads traveling along the support and guide means serves to hold the bobbins in orderly array for stripping; the invention comprises means for readily releasing the hold-down bar from its normal downward bias means and readily raising it clear of the bobbin heads when necessary to clear a jam.

Incline rails slanting downwardly serve to deliver normal spent bobbins by gravity-feed to the entrance end of the supporting, guiding, and feeding means; the invention comprises sloping the rails at an angle causing the bobbins closely approaching the delivery point to support themselves free of contact with the incline rails, whereby a suitably located jet of air may blow down alongside the bobbin heads to propel any loose waste from that vicinity to the space below the bobbin heads.

The incline rails being formed from flat bars of steel turned on edge, in this invention, are provided with slightly relieved areas directly beneath their inside upper edges (where the bobbin head rings ride) and of appropriate vertical extent such that "piece bobbins" whose yarn package diameter barely allows them to drop between the rails will be enabled to slide freely downward along the rails with the yarn packages passing between the relieved areas.

A pivoted bobbin-monitoring arm disposed above the upper portion of the incline rails detects high-riding bobbins traveling therebetween, and in this invention the lower bobbin-engaging edge of this arm is supported spaced above the rails where it will engage an abnormally high-riding bobbin and hold it back until space develops between the held-back bobbin and the preceding bobbin; then, when force from succeeding bobbins builds sufficiently the pivoted arm will rise and allow the held-back bobbin to escape into the developed space and fall into normal position between the rails. If the high-riding bobbin is a "piece bobbin" so large that its yarn package is riding above the rails, this monitoring arm will engage its head and hold it back while succeeding bobbins are forced underneath the "piece bobbin" causing its tip to rise up from between the rails; at this juncture the angular disposition of the bobbin-engaging edge of this monitoring arm will normally cause the "piece bobbin" to fall overboard.

A pair of trough-forming flat feeder belts (spaced apart only enough to receive between them normal spent bobbin barrels) are inclined and run upwardly to deliver bobbins (with barrels depending between the belts) into the incline rails for subsequent gravity feed into the stripping arrangement; the present invention comprises arched helical spring means disposed to maintain proper tension in the feeder belts during normal length variation, and tapered pulleys whose training action supports most of the weight of the feeder belts (allowing fixed guides - at the inner edges of the belts just before they run onto their respective drive pulleys - to support the remaining weight with a minimum of friction and edge wear and thereby hold constant spacing between the belts regardless of edge wear).

A pivoted bobbin-deflecting and retaining arm is provided over the top portion of the incline rails to deflect the swiftly moving bobbins from their trajectories (imparted by the feeder belts) to normal pendent position between the rails, and also to retain at least one bobbin in such normal position near the top end of the rails; the present invention lies in the freely depending hinged end of this arm, which hangs with its lower edge yieldably engaging the heads of all bobbins as they pass along the rails so that at least the last of a string of bobbins delivered by the feeder belts will be held there as a buffer for the next bobbin delivered.

An air-moving blower is arranged in conjunction with the air jet and rotating reel stripping means, and in this invention these stripping means are essentially enclosed and the air supply for the blower is drawn from within the enclosure, through a filter-screen, and filtered air is discharged into a second enclosure which contains the open gears driving the stripping reels; thereby, the dust and lint from the stripping process is kept out of the atmosphere and away from the open gears.

Unstripped bobbins travel onward beyond the stripping operation and are detected and dropped (along with much loose waste) into a belt conveyor which carries them away for eventual stripping; and in this invention the pulleys for this belt are cantilevered, guarded from waste on the cantilevered side, and are left open for passage of waste on the opposite side. Also, by placing the drive pulley at the delivery end of the conveyor and guarding the sag of the lower reach of the belt, this sag provides automatic self-tension for the belt.

The structural arrangement and mode of operation of the equipment is described in fuller detail below in connection with the accompanying drawings that correspond to the following listing.

DETAILED DESCRIPTION OF THE INVENTION

In the illustrated embodiment, typical spent filling bobbins B are shown in FIGS. 1-6 to indicate the manner in which they are presented for stripping according to the present invention. For this purpose, the bobbins B are suspended from their heads H between spaced rails 10 and 12 (see FIG. 2). These rails 10 and 12 form support and guide means for bobbins B and define a given path along which the bobbins B are fed in serial stream while being subjected to stripping action by the stripping equipment.

Figures 2, 2A, 3, 4:
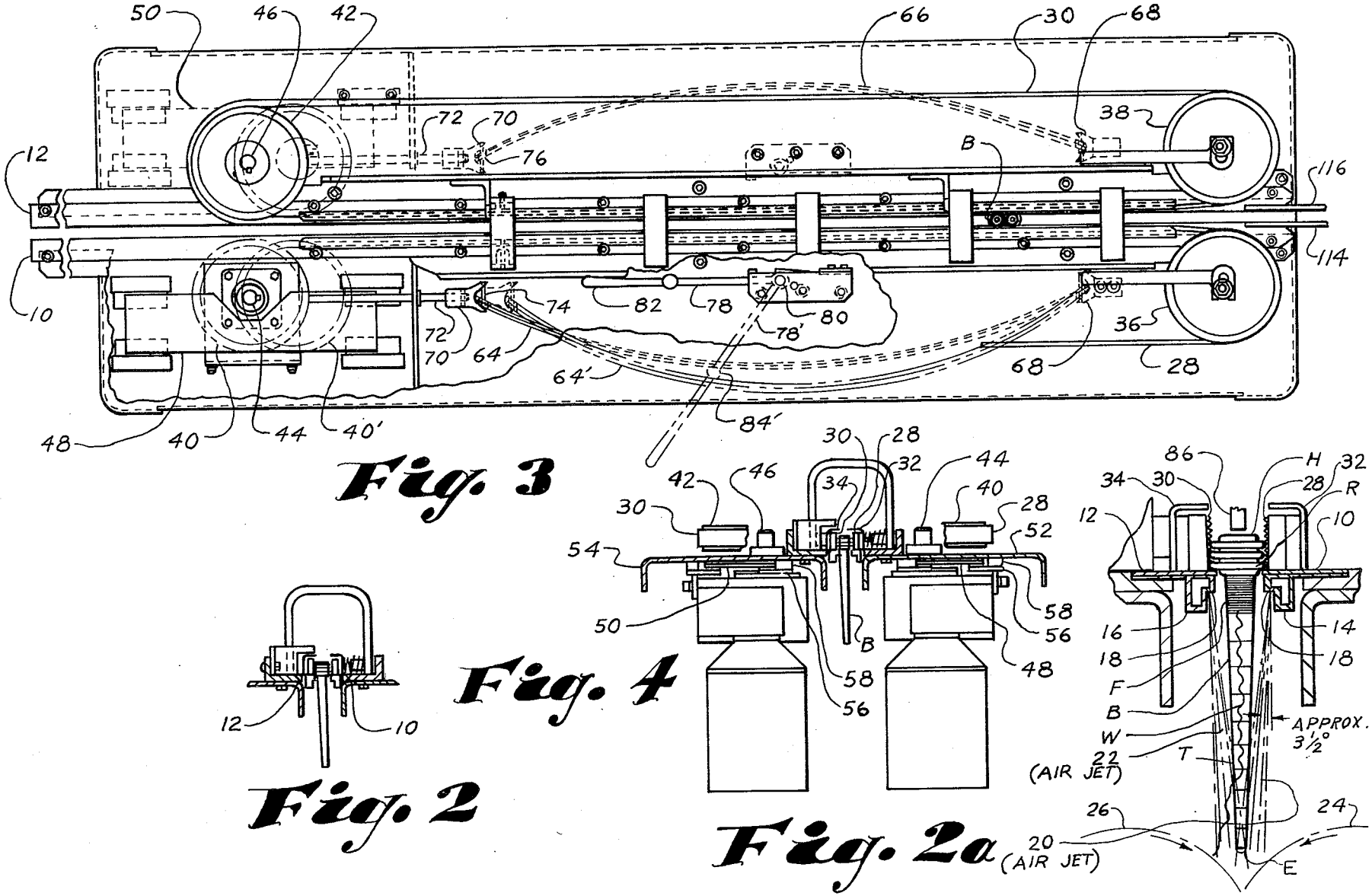
FIG. 2 is a vertical section taken substantially at the line 2—2 in FIG. 1.
FIG. 2A is an enlarged portion of FIG. 2.
FIG. 3 is a plan view corresponding generally to the stripper portion of FIG. 1.
FIG. 4 is a vertical section taken substantially at the line 4—4 of FIG. 1.
Figure 5:
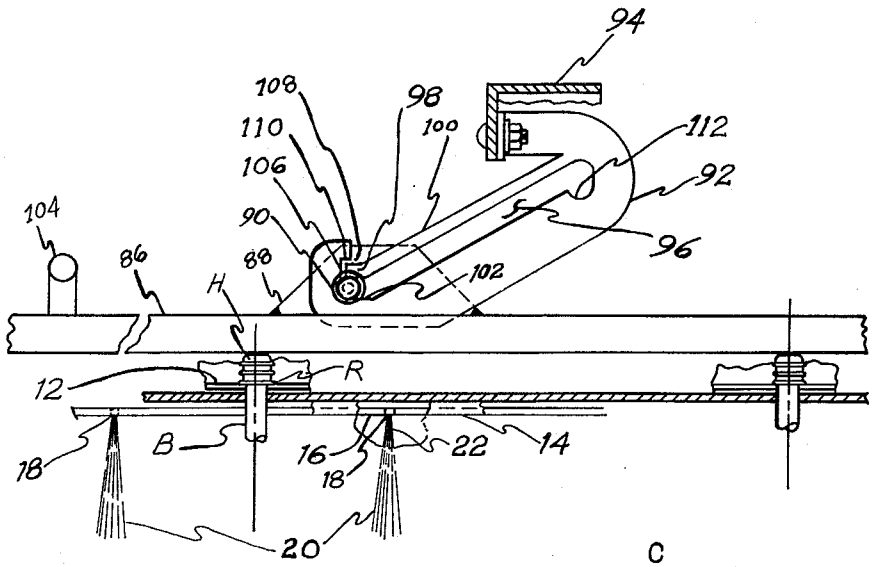
FIG. 5 is a detail in elevation illustrating the hold-down bar biasing, stop, and raising means.

Particularly, the bobbins B ride the spaced rails 10 and 12 on what is normally the top bobbin head ring R, but which is the lowermost one in the suspended position of the feeding bobbins. It will be understood that the head rings R are those conventionally provided on filling bobbins for locating them in loom shuttles. Underneath the supporting rails 10 and 12 respectively are air duct members 14 and 16 which are connected to a source of compressed air supplied normally at about 2–4 atmospheres gage pressure. These air pipes 14 and 16 have a number of pairs of small holes 18 about 1.5 mm in diameter which are aimed inwardly at each side respectively of bobbins B as seen in FIG. 2A at an angle of about 3½° to the vertical so that the compressed air escaping through the holes forms air jets 20 and 22 which strike with full force on the depending bobbin barrels T about one-third of their length up from their tips. As seen in FIG. 5, each pair of air jets 20 and 22 lies in a common vertical plane and both jets of the pair blow simultaneously on each passing bobbin for best stripping action.

Since these air jets have the well-known ability to entrain free air from the surrounding atmosphere, the resultant induced draft of air — downward about the bobbin head H and the feeler bunch F (waste remainder) on the bobbin barrel T — entrains the loose end of yarn W from the bunch F and propels it downward between the rotating stripping reels 24 and 26 for stripping engagement therewith. Unlike previous air jets, which blew directly on the bunch F and had substantially dissipated their velocity before reaching the lower end of bobbin barrel T (thereby blowing largely intact coils of waste yarn down the barrel T only to lose their velocity and remain there tangled), the air jets 20 and 22 of this invention envelope the downwardly tapering bobbin barrel T in an air stream of increasing velocity almost to the barrel tip end E, so that any waste entrained will be pulled along by the loose end W thereof with increasing force and velocity (and without opportunity tok form tangles) until it is blown clear of tip end E.

As is well-known in the art, feed belts 28 and 30 having resilient working surfaces to contact bobbin heads H are disposed with their inner reaches lying above rails 10 and 12 and are biased into operative contact with bobbin heads H by spring means associated with pressure bars 32 and 34. Tension in belts 28 and 30 must be sufficient to constantly feed a full stream of bobbins B through the stripping equipment, yet their length varies with atmospheric conditions, belt wear, and stretch and conventionally has required frequent manual adjustments.

Pulleys 36 and 38 turn freely at fixed positions near the entrance end of the stripping equipment to determine the extent of belts 28 and 30 respectively at one end, while driving pulleys 40 and 42 do likewise at the other end, adjacent the exit end of the stripping equipment. Drive pulleys 40 and 42 are mounted on the output shafts of gearmotors 44 and 46 for powered rotation, and the gearmotors in turn are mounted on slides 48 and 50 respectively for belt-tensioning sliding action guided by frame top members 52 and 54, ways 56, and guide blocks 58 as shown in FIG. 4. Proper tension is automatically applied to belts 28, 30 throughout their normal length variations by bow springs 64, 66 respectively, each spring 64, 66 having one end abutting a fixed V-block 68 while the other end engages a movable V-block 70 which in turn is mounted on a push-rod 72 fixed in slide 48 or 50 respectively. It is convenient to use more than one spring 64, 66 at each side in order to get the proper combination of flexibility, force, physical dimensions, and the springs at a given side may differ from each other.

Each V-block 68, 70 is press-fitted with a cross-pin 74 which passes through an oversized hole 76 in bow spring 64 and 66. Bowing levers 78 as shown in FIG. 3 pivot about fixed pins 80 and have handles 82 for manual rotation to the position shown by broken lines as 78', where the bowing boss 84 on lever 78 will bear against low spring 64 or 66 as at 84' and 64' to create maximum bow and retract pulley 40 to position 40', completely releasing tension on belt 28.

Hold-down bar 86 is suspended closely (about .75 mm) above the row of bobbins B as they travel along rails 10, 12. Ears 88 on bar 86 have threaded holes to receive the threaded ends of shoulder screw 90, and guide brackets 92 are adjustably fastened to the arches 94 of the frame. Guide slots 96 in brackets 92 receive shoulder screws 90 for sliding motion except at the foot 98 of spring leg 100, where slot 96 is narrowed so that foot 98 exerts spring force on shoulder screw 90, thereby holding hold-down bar 86 in a normal operating position as determined by the bottom 102 of slot 96 when hold-down bar 86 is pushed by handle 104 to its extreme position in the direction of flow of bobbins, where it is stopped by contact of shoulder screw 90 against the end 106 of slot 96. Hold-down bar 86 is normally held in this extreme position by frictional forces exerted by the heads H of the stream of bobbins B passing underneath, but it is free to move upward a few millimeters against the bias of spring leg 100 to accommodate the interlocking of rings R on adjacent bobbins B. Relief slots 108 in brackets 92 define the shape of spring legs 100 and are narrowed at the stop portions 110 to restrict the motion of spring feet 98, thereby preventing overstressing of spring legs 100 as well as stopping hold-down bar 86 from rising so high as to allow bobbins B to become staggered, jumbled, and badly jammed thereunder.

However, loom-damaged bobbins, stray loom parts, large balls of waste, endwise traveling bobbins, or other anomalies will occasionally become jammed between hold-down bar 86 and rails 10 and 12, so badly jammed that belts 28 and 30 slip on their respective drive pulleys 40 and 42 and feeding of bobbins B ceases. The bobbin stripping attendant or operator can then easily raise the hold-down bar 86 by pulling it back toward the entrance end of the stripper using the handle 104 fixed atop hold-down bar 86. Such a pull causes shoulder screws 90 to first slide out from under the spring feet 98 and then to slide upwardly in slots 96 — if carried to the upper end of slots 96, shoulder screws 90 drop into detent radii 112 which serve to prevent inadvertent lowering of hold-down bar 86. Reversing the procedure lowers hold-down bar 86 back into operating position. Jams are often cleared by merely raising hold-down bar 86 slightly and then slamming it back down.

As is well-known in the art, incline rails 114 and 116 serve to deliver bobbins B from manual, semi-automatic, or automatic bobbin feeder means 118, into the supporting, guiding, and feeding means (as exemplified by rails 10, 12, belts 28, 30 and hold-down bar 86), of the stripping equipment. Incline rails 114, 116 are inclined sufficiently downwardly toward the stripping equipment so that bobbins B suspended from their heads H will slide freely toward the lower ends of incline rails 114, 116, forming a solid queued column of bobbins B awaiting entry into the belts 28, 30 which commonly feed about 200 bobbins per minute. The queue of bobbins B serves as a valuable reservoir so that a solid column of bobbins B will be fed over the stripping reels 24, 26 despite the usual intermittent flow of bobbins B onto incline rails 114, 116.

Downward inclination of rails 114, 116 at an angle of 25° from horizontal causes bobbins B to rest against each other with such force that the bobbin head rings R are interlocked with each other as the bobbins B transfer from downward travel on rails 114, 116 to horizontal travel as fed along by belts 28, 30. This interlocking causes the bobbin heads H to travel in a divergent path C between some last point of contact P of bobbin head rings R with rails 114, 116, as in FIG. 6, until the heads H are received between belts 28, 30 for horizontal travel. This suspension of bobbins B by their own heads H leaves them clear of rails 114, 116 so that jets 120 of compressed air directed approximately vertically downwardly between bobbin heads H and rails 114 and 116 respectively during this suspension will cause loose waste in the vicinity of bobbin heads H to be propelled into the space below heads H and rails 114, 116 ready for further disposition. Since the loose yarn ends W from feeler bunches F on bobbins B are not infrequently found loosely lying on bobbin heads H, air jets 120 blow many of these ends W down to where air jets 20, 22 will later entrain them for stripping; otherwise, the ends W would likely remain on bobbin heads H (as restrained by rails 10, 12, belts 28, 30 and hold-down bar 86) for passage over the stripping reels 24, 26 without being stripped. Also, much loose waste is blown down from the vicinity of bobbin heads H for harmless disposition.

Figure 6:
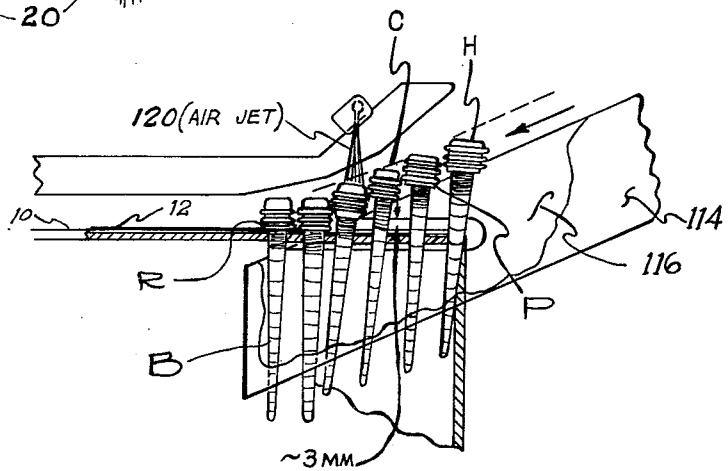
FIG. 6 is a detail in elevation showing the lower end of the incline rails.

The last bobbin B in a queue of bobbins B leaving the ends of rails 114, 116 normally drops onto rails 10, 12 without touching belts 28, 30 and remains hanging there as a buffer for the next succeeding bobbin B, which may descend rails 114, 116 swinging wildly and ripe to enter between belts 28, 30 in a cocked, or even horizontal attitude, liable to jamming, but for the presence of said buffer bobbin. The lower ends of rails 114, 116 as viewed in FIG. 6 are shaped to a blunt 25° point so that their undersides can be placed parallel to, and spaced above rails 10, 12. This space of about 3 mm allows the waste accompanying the stream of bobbins B to pass by largely unobstructed.

Figure 7:
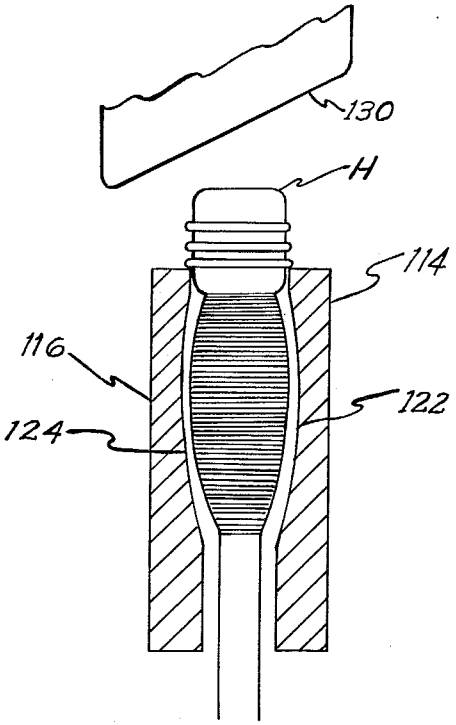
FIG. 7 is a cross-section taken substantially at the line 7—7 in FIG. 1.

Bobbins with larger than normal waste remainder are known and "piece bobbins," and where the diameter of the yarn body on a "piece bobbin" is approximately the same as the spacing for bobbin heads H between incline rails 114, 116 as in FIG. 7, the "piece bobbins" will usually drop into normal depending position as shown in FIG. 7. Previous incline rails have commonly had vertical, parallel inner walls such that a "piece bobbin" of the above-mentioned size, having dropped between the rails by gravity, would then have so much friction between the yarn body and said inner walls that it would not slide downwardly along the rails by gravity, nor even by the additional force exerted by following bobbins. The shallow relieved portions 122 and 124 of incline rails 114 and 116 respectively provide clearance for such a "piece bobbin" to move along freely.

Figure 8:
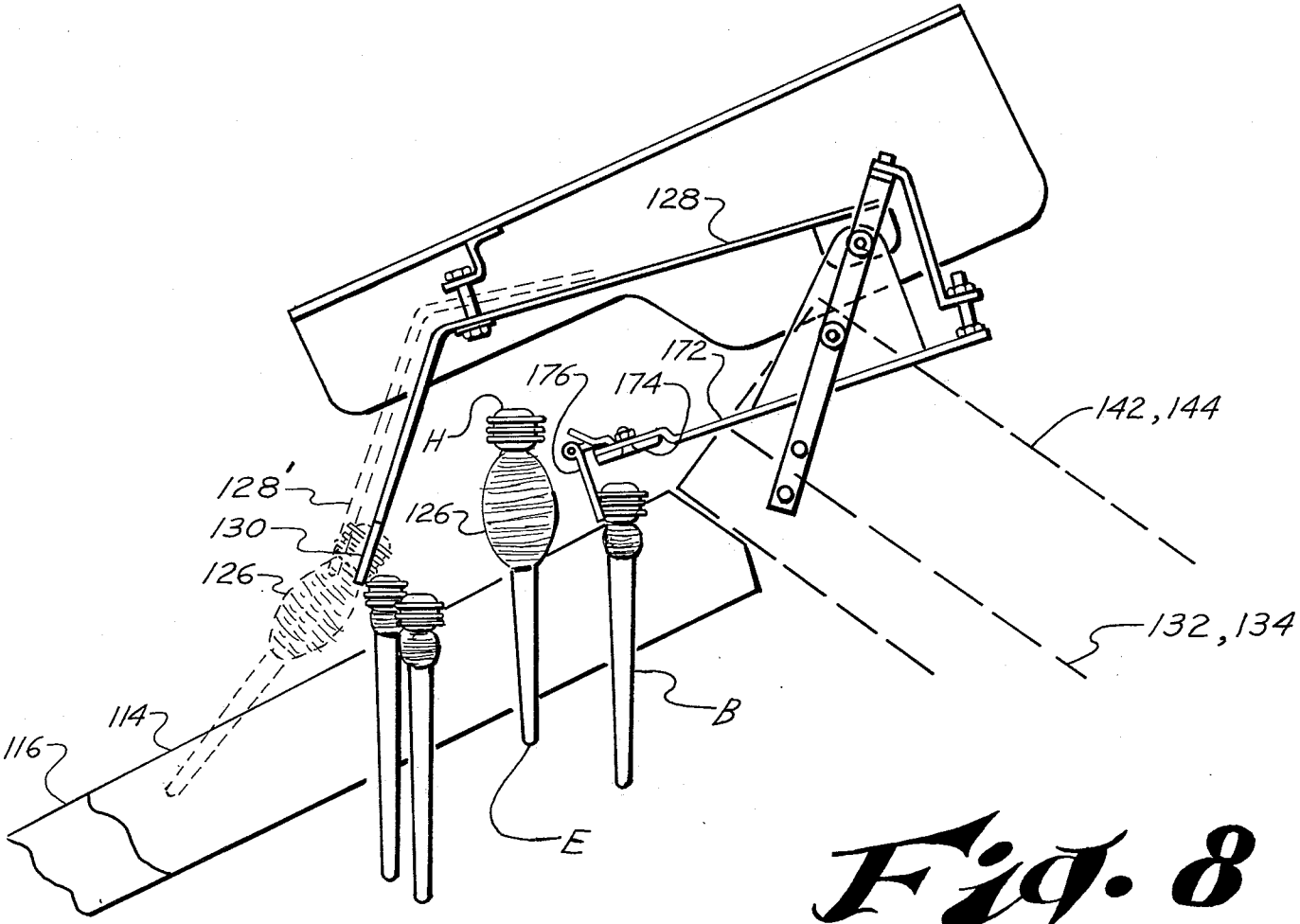
FIG. 8 is a detail in elevation showing the upper end of the incline rails.
Figure 10:
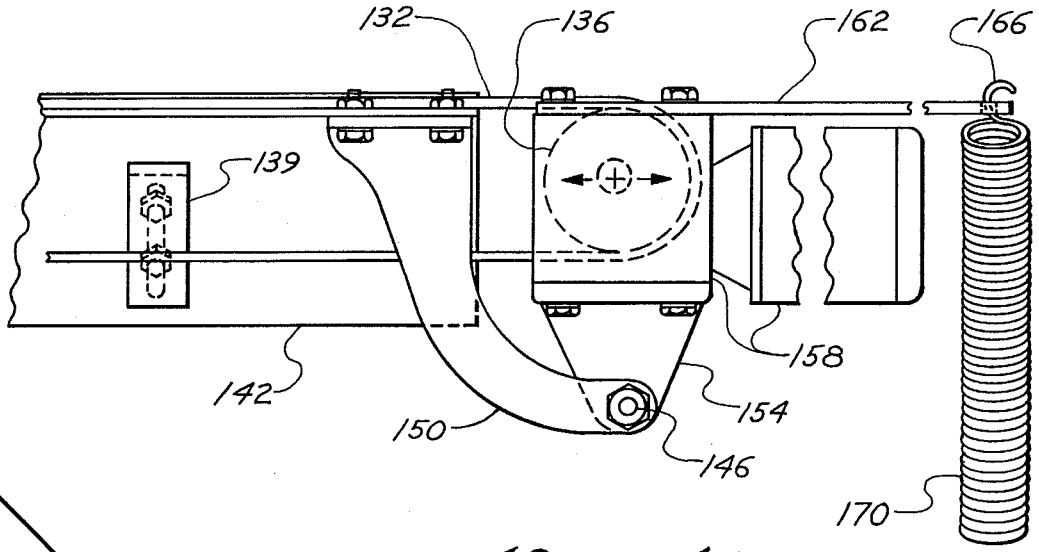
FIG. 10 is an angled view taken substantially at the line 10—10 in FIG. 9 illustrating the mounting of a feeder belt-tensioning pulley.

"Piece bobbins" of an intermediate yarn body size too large to fit between rails 114, 116 also find their way onto said rails, where they will hang by the underside of the oversized yarn body 126 on rails 114, 116 with tip E again depending between said rails as in FIG. 8. As the pressure from succeeding bobbins B forces such a bobbin along the rails the pivoted bobbin monitoring arm 128 stands in the way of farther movement of such bobbin, and by contact with bobbin head H and/or yarn body 126 holds back the upper portion of such a bobbin while succeeding bobbins B are forced under the "piece bobbin" until it is raised clear of incline rails 114, 116, arm 128 being pivotally raised by said "piece bobbin" at the same time to a position as shown at 128′ or higher. The transverse bobbin-engaging free end 130 of monitoring arm 128 is angled as seen in FIG. 7 and causes such a raised-clear "piece bobbin" to fall overboard of rails 114, 116. A suitable stop contacting arm 128 positions said bobbin-engaging end 130 at a height above rails 114, 116 such that it is clear of normally positioned bobbin heads H, but at a height such that it will be contacted by a high-riding bobbin head H whose rings R are all riding above those of the next succeeding normally-positioned (rings R essentially riding on rails 114, 116) bobbin B. Such a high-riding bobbin head will be held back by end 130 of arm 128 until force from following bobbins lifts end 130 sufficiently for said high-riding bobbin head to move under end 130, by which time space will normally have developed lower in the column of bobbins on rails 114, 116 so that the high-riding bobbin head will fall down into normal position between rails 114, 116.

Figure 9:
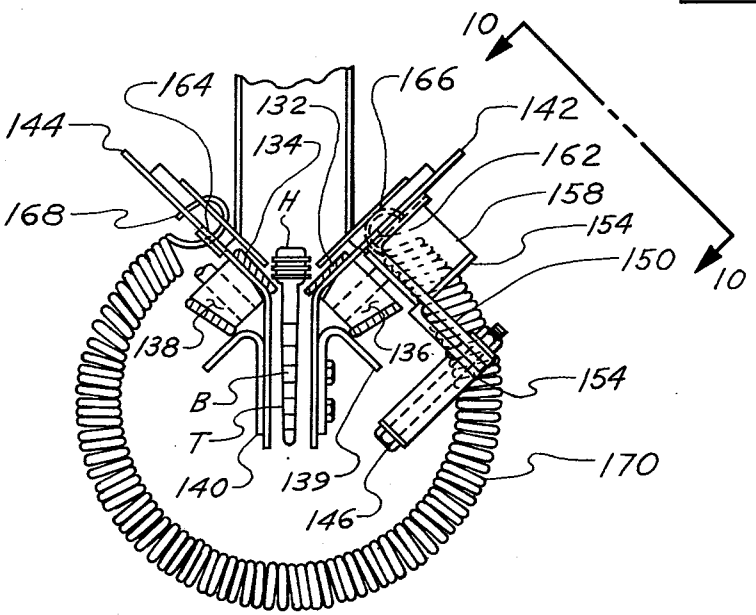
FIG. 9 is a cross section taken substantially at line 9—9 in FIG. 1.

As is well-known in the art, a pair of trough-forming endless flat belts 132 and 134, inclined upwardly and their upper reaches moving upwardly, are spaced apart to receive normal spent bobbin barrels T therebetween while the bobbin heads H ride on the innermost edges of the belts 132, 134 for feeding bobbins B upwardly and beyond the extent of belts 132, 134 and into normal depending position between incline rails 114, 116. Driven upper pulleys in fixed position define the lengthwise upward extent of belts 132, 134, while driving lower pulleys 136 and 138 in FIG. 9 define the lengthwise downward extent of said belts. The axes of all said pulleys being angled down from horizontal, the natural tendency of belts 132, 134 is to run to the lower end of the respective pulleys; therefore, all of said pulleys are provided with downwardly tapered barrels as indicated in FIG. 9 so that the well-known training action of tapered-barrel pulleys will mostly overcome said tendency of the belts to run to the lower ends of the pulleys, with the result that the remaining small downward running tendency, or weight, of the belts will be balanced by stationary belt guides 139, 140 located to contact the lower edges of the respective belts 132, 134 just before they run into said driving lower pulleys 136, 138 respectively. Thereby, when wear occurs at the bobbin-carrying inner edges of said belts 132, 134, they will automatically descend into contact with belt guides 139, 140, so that the lateral spacing between the inner edges of belts 132, 134 will remain at the optimum for receiving and feeding bobbins B without need for manual adjustments; but the guides 139, 140 will cause no significant wear on the edges of belts 132, 134.

Flare plates 142 and 144 form supports and framework for mounting the pulleys associated with feeder belts 132, 134 as well as forming additional trough means for containing bobbins B as they are shuffled and sorted by said belts acting on said bobbins. Shoulder screws 146 and 148 are fixed at the overhanging ends of support brackets 150 and 152 which are in turn adjustably attached to flare plates 142 and 144 respectively, and swing arms 154 and 156 respectively are pivoted on the shoulder screws 146, 148. Driving lower pulleys 136 and 138 are mounted on the driving shafts of gearmotors 158 and 160 respectively, and said gearmotors are in turn mounted on swing arms 154, 156 so that the pulleys 136, 138 are movable in swing arcs which define pulley motion for tightening belts 132, 134 practically parallel to the lengthwise extent of said belts. Extension bars 162 and 164, fixed to gearmotors 158 and 160 respectively, extend approximately parallel to and beyond the lower ends of belts 132, 134 and contain notches at their farther ends into which are hooked the hook ends 166 and 168 of the helical extension spring 170. Said spring 170 is arched into position as shown in FIG. 9 and thereby exerts practically constant separating force between extension bars 162 and 164, which in turn automatically exert practically equal and constant belt-tensioning force on driving lower pulleys 136, 138.

Feeder belts 132, 134 run at a velocity considerably greater than that of the column of bobbins B moving along incline rails 114, 116, such that bobbin heads H leaving the upper ends of belts 132, 134 commonly move in a trajectory above the upper ends of incline rails 114, 116 before settling down between said rails unless there is a solid column of bobbins B completely filling the incline rails 114, 116. Therefore, a pivoted bobbin-deflecting and detaining arm 172 as in FIG. 8 is mounted above the upper end portions of incline rails 114, 116 firstly to deflect downwardly the bobbin heads H from their trajectory as they leave belts 132, 134, and secondly to always retain at least one bobbin B near the upper end of rails 114, 116 as a buffer for wildly swinging, endwise oriented, or otherwise anomalous bobbins entering between said rails. The underside of arm 172 is lined at the area of impingement of bobbin heads H with an elastomeric sound-deadening segment 174 disposed at such an angle as not to impede the flow of bobbins by friction therewith, but which will deflect said bobbins downwardly and quietly. At the lower end of arm 172 a weighted freely-hinged flap 176 hangs down into the path of normally positioned bobbin heads H such that all passing bobbin heads must lift the hinged flap 176 to pass by, and the weight of hinged flap 176 is such that it will detain a single bobbin B propelled by belts 132, 134 to enter rails 114, 116. Said flap 176 will also retain at least the last one of multiple bobbins B moving in column thereunder.

Figure 1:
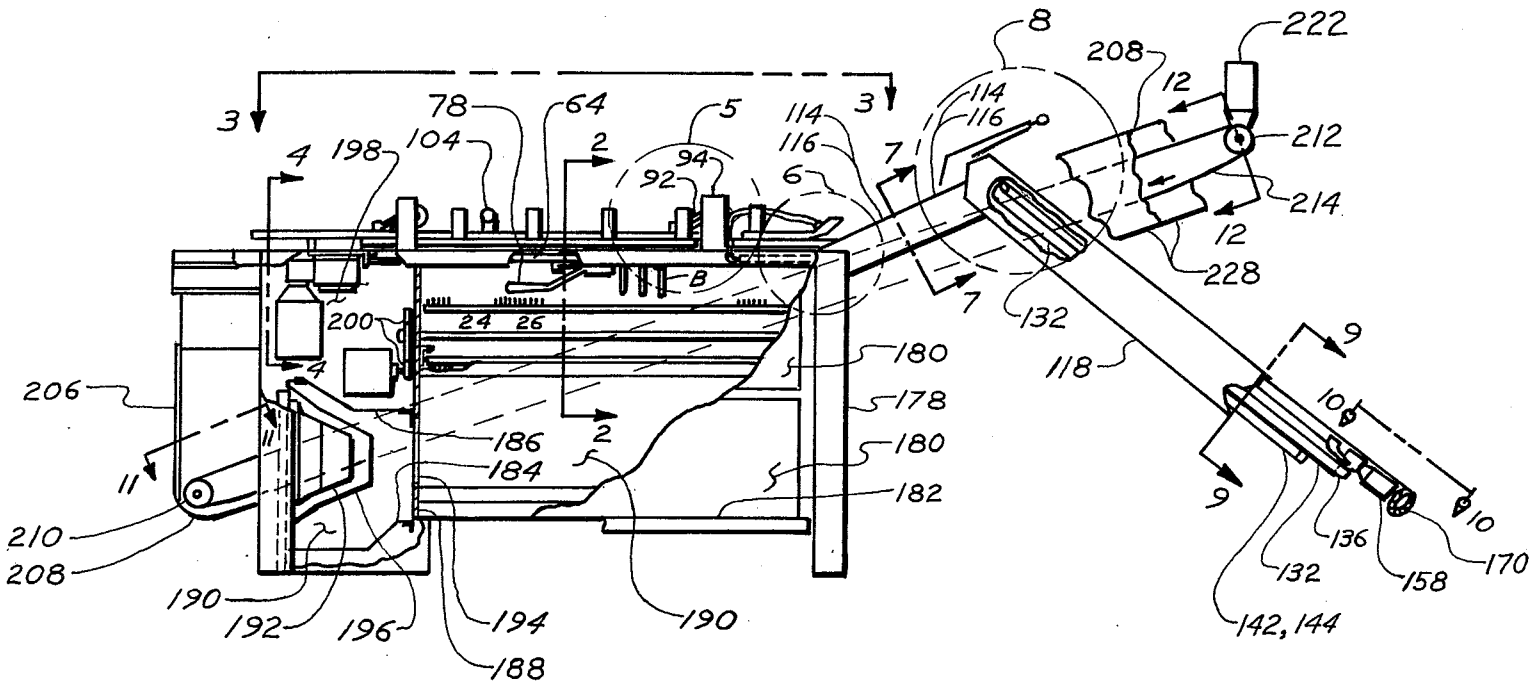
FIG. 1 is a side elevation of a stripping and feeding arrangement according to the present invention, partially cut-away.

The frame 178 (surrounding and supporting reels 24, 26, rails 10, 12, air pipes 14, 16, and other recited stripping and feeding elements) forms with side covers 180, bottom panel 182, and lower baffle 184 in FIG. 1 an essentially complete enclosure for the noise-, dust-, and lint-producing elements of the stripping equipment; said enclosure reduces noise radiation to acceptable safety limits. Upper baffle 186 and the upper portion of center plate 188 of frame 178 define a suction chamber 190 within said enclosure, said suction chamber 190 containing the dust- and lint-producing elements of the stripping equipment. Air moving blower 192 sucks air from suction chamber 190 (a large opening 194 in the lower portion of center plate 188 joins the larger and smaller sections of chamber 190) through a plastic filter screen 196 which screens off the entire left end of chamber 190 as seen in FIG. 1. Outside air is drawn into chamber 190 by blower 192 through various cracks and openings and with sufficient velocity to entrain and carry airborne dust and lint through chamber 190 for deposit on screen 196. Filtered air is dispelled from the left side of blower 192 as seen in FIG. 1, and some of this air is blow upward into pressure chamber 198 (defined within said complete enclosure by upper baffle 186 and the upper portion of center plate 188) to create a slight positive air pressure within chamber 198 to keep out any lint- and dust-laden air, especially to keep lint and dust from collecting on the drive gears 200 for rotating reels 24, 26.

Figure 11:
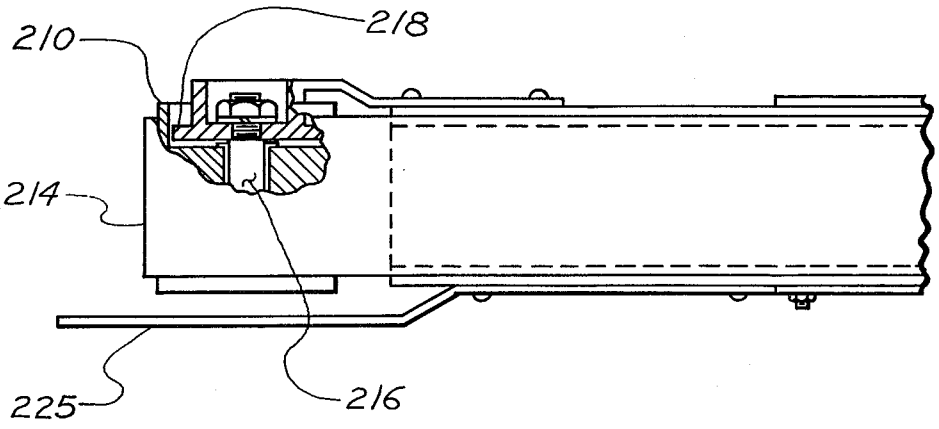
FIG. 11 is essentially a plan view taken substantially at line 11—11 of FIG. 1 corresponding generally to the lower pulley section of the rehandling conveyor, partially cut away.
Figure 12:
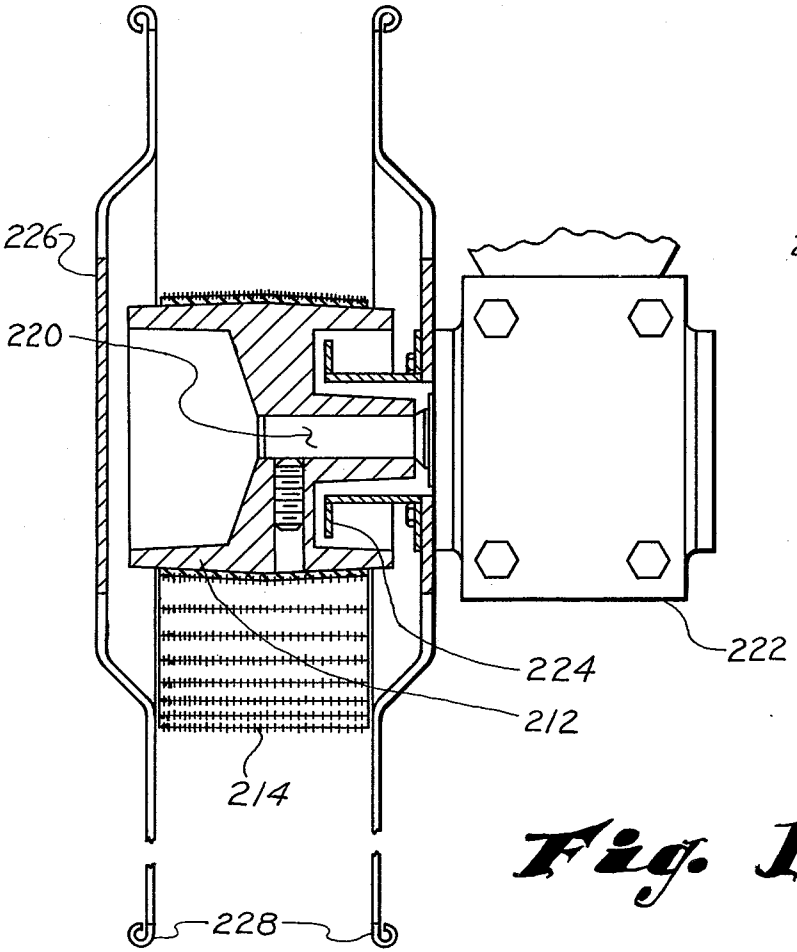
FIG. 12 is a cross section of the upper pulley end of the rehandling conveyor taken substantially at the line 12—12 in FIG. 1.

At the discharge end of rails 10, 12 a well-known bobbin inspection device removes unstripped bobbins B from the on-going stream of bobbins, causing said unstripped bobbins to fall down into chute 206 which funnels said unstripped bobbins (as well as a lot of lint and yarn waste which has been riding along with the stream of bobbins and falls down at this point) into a return conveyor 208 which carries said unstripped bobbins (and some misdirected stripped bobbins) up and away from said discharge end for deposit in a box or for direct re-run through the stripping equipment. The yarn ends from these bobbins, as well as the accompanying loose waste, have a natural tendency to wrap or accumulate at various places on the conveyor including the shafts and hubs of respective driven and driving pulleys 210 and 212, which form conveyor 208 together with endless conveyor belt 214. To hinder such accumulations of waste, pulleys 210 and 212 are supported from the conveyor structure at one end only of each pulley; i.e., driven pulley 210 is cantilevered on a fixed stud shaft 216 and rotated freely thereon while enshrouding at its inboard end a stationary guard 218 as shown in FIG. 11, and driving pulley 212 is cantilevered on the output shaft 220 of driving gearmotor 222 for powered rotation while enshrouding at its inboard end a second stationary guard 224 as shown in FIG. 12 — lower and upper conveyor side pieces 225 and 226 are spaced from the unsupported ends of pulleys 210 and 212 respectively at spaces of less extent than the diameter of the barrel tip end E, so that waste can pass through the spaces, but bobbin barrels T cannot wedge therein. By placing driving pulley 212 at the output end of conveyor belt 214, and by allowing for the normal free unsupported sag from wear and stretch in belt 214 by the lower vertical extent of conveyor sides 228 (belt 214 must not sag below sides 228 for safety), belt 214 is automatically self-tensioned by said unsupported sag.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. In a filling bobbin stripper incorporating means for supporting and guiding bobbins serially in a path while hanging from the heads thereof, and rotating reel means spaced below said hanging bobbins for engaging and removing waste from the depending barrels thereof, the improvement which comprises air ducts disposed immediately below the supporting means on which said bobbins are guided and adjacent the guided bobbins, said air ducts being formed to direct an air blast downwardly along said depending bobbin barrels aimed at a zone about two-thirds downwardly of the depending barrel length to entrain waste therefrom and direct said waste for engagement by said reel members.

2. The improvement defned in claim 1 wherein said air ducts are formed to aim the air blast directly downwardly thereof at an angle of about $3\frac{1}{2}°$ with respect to the vertical axis of the depending barrels.

3. The improvement defined in claim 1 wherein a pair of traveling belts is disposed immediately above the supporting means on which said bobbins are guided to engage said bobbin heads and move said bobbin along said path, said belts being extended between respective pulleys at opposite ends and opposite sides of said path, the pulleys at at least one end of said path being movably mounted essentially parallel to said path, bow springs being provided to impose a spreading bias on the respective movably mounted pulleys at each side of said path to maintain said belts normally properly tensioned, and means operatively disposed to selectively relieve or apply said bow spring pressure as desired.

4. In a filling bobbin stripper incorporating means for supporting and guiding bobbins serially in a path while hanging from the heads thereof, the improvement which comprises a pair of traveling belts disposed immediately above the supporting means on which said bobbins are guiided to engage said bobbin heads and move said bobbins along said path, said belts being extended between respective pulleys at opposite ends and opposite sides of said path, the pulleys at at least one end of said path being movably mounted essentially parallel to said path, bow springs being disposed in engagement with the movable pulley mountings at each side of said path to impose a bias thereon maintaining said belts properly tensioned normally, and means opeatively disposed to selectively relieve or apply said bow spring pressure as desired.

5. The improvement defined in claim 1 wherein a hold-down bar is disposed immediately above the heads of said bobbins to maintain them hanging in an orderly series as they are guided along said path, said hold-down bar being normally mounted under a downward bias against a lower positive stop, but being releasable from said downward bias for raising to an upper stop at which said hold-down bar may be hung clear of said bobbin heads whenever desired.

6. In a filling bobbin stripper incoporating means for supporting and guiding bobbins serially in a path while hanging from the heads thereof, the improvement which comprises a hold-down bar disposed immediately above the heads of said bobbins to maintain them hanging in an orderly series as they are guided along said path, said hold-down bar being normally mounted under a downward bias against a lower positive stop, but being releasable from said downward bias for raising to an upper stop at which said hold-down bar may be hung clear of said bobbin heads whenever desired.

7. The improvement defined in claim 1 wherein incline rails for supporting and guiding bobbins downwardly and serially while traveling by gravity and hanging from the heads thereof are disposed to deliver said bobbins to said supporting and guiding means spaced above said reel means, said incline rails being disposed lengthwise at an angle from horizontal causing the bobbins to support themselves during delivery; and at least one air duct disposed and formed to direct an air blast downwardly between bobbin heads and at least one of said incline rails to dislodge waste and direct it below the bobbin heads, the lower ends of said incline rails being spaced sufficiently above the first-mentioned supporting and guiding means for free passage of waste through the space provided thereby.

8. In a filling bobbin stripper incorporating means for spporting and guiding bobbins serially in a path while hanging from the heads thereof, the improvement which comprises incline rails for supporting and guiding bobbins downwardly and serially while traveling by gravity and hanging from the heads thereof and disposed to deliver said bobbins to said first-mentioned supporting and guiding means, said incline rails being disposed lengthwise at an angle from horizontal causing the bobbins to support themselves during delivery; and at least one air duct disposed and formed to direct an air blast downwardly between bobbin heads and at least one of said incline rails to dislodge waste and direct it below the bobbin heads, the lower ends of said incline rails being spaced sufficiently above said first-mentioned supporting and guiding means for free passage of waste through the space provided thereby.

9. The improvement defined in claim 8 wherein said incline rails are disposed at an angle of about 25° to horizontal, and the lower ends thereof are spaced vertically from and above said first supporting and guiding means by about 3 mm.

10. The improvement defined in claim 8 wherein the inner vertical surface of each incline rail is relieved immediately below the bobbin-head supporting and guiding surface deeply enough and for a vertical extent only sufficient to allow a "piece bobbin" which will slip into normal hanging position between the incline rails to be free to travel normally along said rails.

11. The improvement defined in claim 8 wherein a pivoted monitoring arm is disposed above and reaching downwardly over the upper end portion of the incline rails with a bobbinhead-engaging free end thereof supported clear of normally hanging bobbin heads riding said rails but sufficiently close to said rails to engage a bobbin head riding with its rings above the rings of the succeeding bobbin, with said free end spaced about a bobbin length from the upper end of said rails, said bobbin-engaging end having an angular transverse edge.

12. The improvement defined in claim 8 wherein a pair of upwardly traveling laterally spaced-apart belts is disposed to supply normal spent bobbins to said stripper, these upwardly traveling belts having their flat surfaces angularly disposed to form a trough for receiving and feeding bobbins to said stripper while hanging from the heads thereof between said belts, said belts being extended between respective driving and driven pulleys at opposite ends and opposite sides of said trough, the pulleys at at least one end of said trough being mounted for movement approximately parallel to the trough, at least one bias means being provided to bias the movement of said pulleys at each side of said trough to normally tension the belts properly, said pulleys being provided with downwardly tapered barrels for engagement with the belts such that the weight of said belts is largely supported by the action of the tapered pulleys, a stationary belt guide being provided near each driving pulley to guide the inner edge of its belt on its return path to the drive pulley, thereby holding a constant lateral spacing between said belts for reception of downwardly depending bobbin barrels.

13. In a filling bobbin stripper incorporating means for supporting and guiding bobbins serially in a path while hanging from the heads thereof, the improvement which comprises a pair of upwardly traveling laterally spaced-apart belts disposed to supply normal spent bobbins to said stripper, these upwardly traveling belts having their flat surfaces angularly disposed to form a trough, for receiving and feeding bobbins to said stripper while hanging from the heads thereof between said belts, said belts being extended between respective driving and driven pulleys at opposite ends and opposite sides of said trough, the pulleys at at least one end of said trough being mounted for movement approximately parallel to the trough, at least one bias means being provided to bias the movement of said pulleys at each side of said trough to normally tension the belts properly, said pulleys being provided with downwardly tapered barrels for engagement with the belts such that the weight of said belts is largely supported by the action of the tapered pulleys, a stationary belt guide being provided near each driving pulley to guide the inner edge of its belt on its return path to the drive pulley, thereby holding a constant lateral spacing between said belts for reception of downwardly depending bobbin barrels.

14. The improvement defined in claim 8 wherein a pivoted bobbin deflection and detainer arm is disposed above and reaching downwardly over the upper end portion of the incline rails, with a bobbin-engaging end thereof comprising a hinged member depending freely from the lower end of the main member of said hold-down bar, said depending hinged member having a free end spaced above said incline rails such that it engages the head of and detains yieldably a normally hanging bobbin, said hinged member being spaced a few bobbin head spaces from the upper end of said incline rails.

15. The improvement defined in claim 1 wherein air moving means creates a partial vacuum in an essentially enclosed compartment containing said reel means, moves air from said compartment through a screen, and discharges filtered air.

16. The improvement defined in claim 15 wherein filtered air is dispelled into a second essentially enclosed compartment containing gears driving said reel means.

17. The improvement defined in claim 1 wherein at the discharge end of said supporting and guiding means unstripped bobbins are dropped onto a belt conveyor for rehandling disposition, said belt being trained over pulleys and being self-tightening by the sag of its lower reach, each of said pulleys being cantilevered and being guarded by a stationary member at the cantilevered side.

* * * * *